US007210597B2

(12) United States Patent
Enenkel et al.

(10) Patent No.: US 7,210,597 B2
(45) Date of Patent: May 1, 2007

(54) BOX-LIKE CONTAINER FOR FLAT MAILINGS

(75) Inventors: Peter Enenkel, Constance (DE); Markus Osswald, Backnang (DE)

(73) Assignee: Siemens AG, München (DE)

( * ) Notice: Subject to any disclaimer, the term of this patent is extended or adjusted under 35 U.S.C. 154(b) by 41 days.

(21) Appl. No.: 11/087,035

(22) Filed: Mar. 23, 2005

(65) Prior Publication Data

US 2005/0161457 A1 Jul. 28, 2005

Related U.S. Application Data

(63) Continuation of application No. PCT/DE03/02500, filed on Jul. 24, 2003.

(30) Foreign Application Priority Data

Jul. 30, 2002 (DE) ..... 102 34 516

(51) Int. Cl.
*B65D 6/28* (2006.01)
*B65D 57/00* (2006.01)

(52) U.S. Cl. ..... 220/608; 220/532; 220/533; 220/529; 220/DIG. 6

(58) Field of Classification Search ..... 220/608, 220/529, 532, 533, 571, 572, DIG. 6; 206/505, 206/507, 561, 449, 425
See application file for complete search history.

(56) References Cited

U.S. PATENT DOCUMENTS 2,261,840 A * 11/1941 Bergmann ..... 220/532
2,985,333 A * 5/1961 Kirkman ..... 220/533
3,117,688 A * 1/1964 Walstad et al. ..... 217/7
3,200,983 A 8/1965 Walter
3,920,144 A * 11/1975 Callen ..... 220/533
4,234,089 A * 11/1980 Morris ..... 206/456
4,593,816 A 6/1986 Langenbeck
5,454,633 A * 10/1995 Nemeth ..... 312/9.54
5,908,133 A * 6/1999 Luburic et al. ..... 220/572
6,026,967 A 2/2000 Isaacs et al.

FOREIGN PATENT DOCUMENTS

| | | |
|---|---|---|
| AT | 236856 | 11/1964 |
| DE | G8913760.4 | 2/1990 |
| DE | 4203851 A1 | 8/1993 |
| DE | 4438981 A1 | 5/1996 |
| EP | 0109325 A1 | 5/1984 |
| FR | 2 621 297 A1 | 4/1989 |
| WO | WO 97/36523 | 10/1997 |

OTHER PUBLICATIONS

Derwent Abstract—DE-4438981A1; May 2, 1996; Thyssen Polymer GmbH, D-81671 München (Germany).

(Continued)

*Primary Examiner*—Anthony D. Stashick
*Assistant Examiner*—Eugene Lhymn

(57) ABSTRACT

The invention relates to a box-like container for flat mailings in the upright position, comprising a stack support, which may be removed from the container open at the top, a base, two narrow front face walls and two lateral longitudinal walls. The mailings are arranged with the largest sides thereof facing the front face walls. The inner sides of the lateral longitudinal walls comprise straight long recesses, open to above, arranged at regular intervals perpendicular to the base, which are wider in the longitudinal direction of the lateral longitudinal walls than the slot like openings thereof to the container interior. The stack supports have formed elements at both lateral ends thereof which may only be slid into place in the long recesses perpendicular to the base with a positive fit connection through the slot like opening.

5 Claims, 4 Drawing Sheets

OTHER PUBLICATIONS

Derwent Abstract—DE-4203851A1; Aug. 12, 1993; Mantz GmbH; D-5650 Solingen (Germany).

Abstract—DE-G-8913760.4; Feb. 22, 1990; Horst Gruber, D-8000 München (Germany).

Abstract -AT-236856; Nov. 10, 1964; Brüder Assann; A-Leibnitz (Steiermark)-(Austria).

Derwent Abstract—EP 0109325; May 23, 1984; Allibert S.A., 129, avenue Léon Blum; F-38042 Grenoble Cedex (France).

Derwent Abstract—FR-2621297; Apr. 7, 1989; Allibert S.A., 129, avenue Léon Blum; F-38042 Grenoble Cedex (France).

* cited by examiner

BOX-LIKE CONTAINER FOR FLAT MAILINGS

CROSS REFERENCE TO RELATED APPLICATIONS

The present application is a continuation of international application PCT/DE03/02500, filed on Jul. 24, 2003, which designated the United States and was pending at the time of designation and the filing of the present application; and further claims priority to German patent application 10234516.3, filed Jul. 30, 2002; the both of which are herein incorporated by reference.

BACKGROUND OF THE INVENTION

The invention relates to a box-like container for flat mailings in an upright position, having a stack support that can be removed from the container open at the top, and having a base, two narrow end walls and two lateral longitudinal walls. The mailings are aligned in the container with their large sides toward the end walls.

Modern letter sorting systems reach peak throughputs of up to approx. 45,000 mailings per hour. Emptying is generally carried out manually, that is to say the sorted stacks of mailings are transferred from the sorter into mail containers by hand. The mail containers themselves are then either stacked manually on trolleys or transferred to modern tray management systems. This manual process is associated with a high error rate of the operator, a high monotonous loading on the operator and very low throughputs.

When the mailings are fed into the sorter, there is generally likewise a manual transfer from containers to the separating apparatus of the sorter.

A further increase in output would therefore require additional operating personnel and therefore reduce the profitability of the sorting system.

In EP 0 109 325, FR 2 621 297, mail containers needed for this purpose are described. These consist of plastic (PP) and have various reinforcements in order to achieve the necessary dimensional stability. These containers are shaped in such a way that, given mutual alignment with one another and with an alignment rotated through 180° about the vertical axis in relation to one another, they can be stacked in one another.

In this connection, a container that is suitable for flat mailings in an upright position has been disclosed (DE 89 13 760 U1), whose inner sides of the lateral longitudinal walls have elongated recesses open at the top and running in straight lines at regular intervals at right angles to the base for a removable stack support which, in the longitudinal direction of the lateral longitudinal walls, are wider than their slot-like openings toward the interior of the container. At its two lateral ends, the stack support has shaped elements which can be pushed into the elongated recesses through the slot-like openings with a form-fitting connection only at right angles to the base. These recesses are wider in the longitudinal direction of the lateral longitudinal walls than their slot-like openings. In U.S. Pat. No. 3,200,983, the recesses are formed as dovetail guides.

For further increases in throughput, the development of automatic filling and emptying machines and the mail transport containers suitable for this purpose are required.

For this purpose, what is known as the mail cartridge system (MCS) is known (U.S. Pat. No. 6,026,967, WO 97/36523), in which use is made of a specific container which, itself formed as a stacking compartment, is suspended directly on the sorter in front of the stacking mechanism. The sorting is carried out directly in the cartridge-like container without a transfer process. After the sorting process has been completed, the cartridge is removed by a robot on the sorter, replaced by an empty cartridge and transferred to a buffer or transport system. The disadvantages inherent to the MCS system are, firstly, the complex and heavy cartridge, on account of the high functional integration, the considerably increased transport costs, the lack of any ability to be stacked and nested, restricted suitability for air freight and, secondly, the low filling rates of the containers. These cannot subsequently be filled with mailed goods.

The invention is based on the object of providing a box-like container having a removal stack support in order to hold and to transport flat mailings, in which, in spite of side walls with a low rigidity, secure retention of the stack support absorbing the stacking pressure is ensured in various positions corresponding to the stack size, and which prevents uncontrolled slippage of the mailings at right angles to the stacking direction.

SUMMARY OF THE INVENTION

According to the invention, the object is achieved by the features of claim 1.

The inner sides of the lateral longitudinal walls of the containers have elongated recesses open at the top and running in straight lines at regular intervals at right angles to the base which, in the longitudinal direction of the lateral longitudinal walls, are wider than their slot-like openings toward the interior of the container. At its two lateral ends, the stack support has shaped elements which can be pushed in the elongated recesses through the slot-like openings with a form-fitting connection only at right angles to the base. The stack support is therefore introduced from above with its shaped elements into two opposite recesses and pushed downward as far as the base. In the process, the recesses are chosen such that the respective stack or part stack is kept under a specific stacking pressure.

There are longitudinal ribs in the base of the container. On the longitudinal ribs, the mailings can easily be displaced in the container longitudinal direction, which is necessary when joining two part stacks together or in order to produce a specific stacking pressure. Since mailings of different formats are transported in the container, slippage of the smaller mailings at right angles to the stack direction during transport is to be avoided in order that the necessary stacking pattern is maintained for further processing. This is achieved in that the heights of the longitudinal ribs decrease from the lateral longitudinal walls toward the center of the container. As a result, the mailings tilt toward the center over the longitudinal rib closest to the container side wall and remain caught by their leading edges on the next longitudinal rib, by which means displacement is prevented.

In the base of the container, at the spacing of the recesses, there are transverse ribs subdivided into partial transverse ribs by the longitudinal ribs. On the partial transverse ribs, the stack support pushed completely into the container and having cutouts for the longitudinal ribs is additionally supported against the stacking pressure in the recesses in addition to the lateral guidance, as result of which the bending stress acting on the stack support is reduced.

Advantageous refinements of the invention are presented in the subclaims.

In order that a stack support consisting of plastic (PP) has the necessary rigidity and the fabrication costs are kept low, it is advantageous for this to be of double-walled design and, on each side, to provide two shaped elements at the spacing from one another of the recesses of the container wall, said shaped elements being angled away from one another at their ends.

The partial transverse ribs advantageously have a saw-tooth-like profile, whose tooth tips are formed by the upper edges of the longitudinal ribs. The steep tooth flanks are oriented toward the longitudinal walls of the container.

If the container is designed in such a way that a plurality of containers can be stacked on one another, given the same alignment, and, given a mutual alignment rotated through 180° about the vertical axis, can be stacked partly in one another, then the stack support is advantageously designed to be only so high that it does not touch the base of the respective upper container when they are stacked in one another. As a result, the stack support can remain in a secure captive position.

In order to permit an automatic loading and unloading sequence, the stack support advantageously has two handle receptacles, which can be centered, for machine handling.

BRIEF DESCRIPTION OF THE SEVERAL VIEWS OF THE DRAWINGS

The invention will be explained in more detail in the following text in an exemplary embodiment and using the drawings, in which.

DETAILED DESCRIPTION OF THE INVENTION

Figure 1:
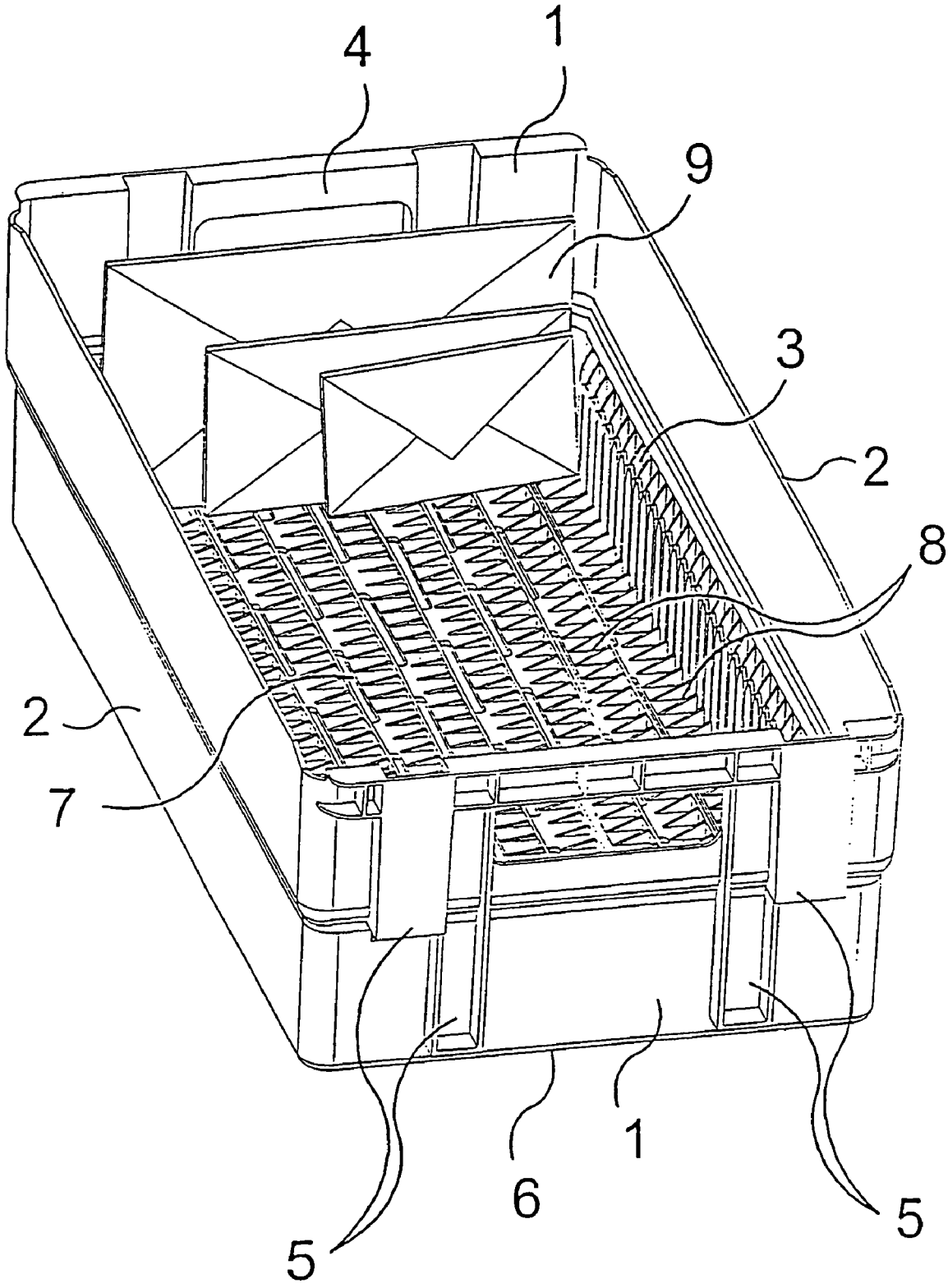
FIG. 1 shows a perspective illustration of a container for flat mailings without stack support.

In FIG. 1 a container according to the invention is illustrated without inserted stack support. It has two end walls 1, two lateral longitudinal walls 2 having elongated recesses 3 open at the top and running in straight lines at right angles to the base 6 on the insides. The side walls 1, 2 have no reinforcements and, in the upper part, are offset outward somewhat in order to permit stacking in one another. In the end walls there are two handles 4 for manual transport and stacking means 5, which are arranged and designed in such a way that, given the same orientation, the containers stand on one another (the upper container does not dip into the lower container) and, given a mutual alignment the containers rotated through 180° about the vertical axis, the respective upper container dips into the lower container, depending on the height of the outwardly offset part of the side walls 1, 2. As can be seen, the mailings 9 are parallel to the end walls 1. In the base 6, there are longitudinal ribs 7 running parallel to the lateral longitudinal walls 2.

The height of the longitudinal ribs 7 decreases from the longitudinal walls 2 toward the center. As a result, the mailings 9 tilt over inward and each mailing 9 remains caught on the respective next longitudinal rib 7, since the longitudinal ribs 7 become higher again beyond the center of the container.

Figure 2:
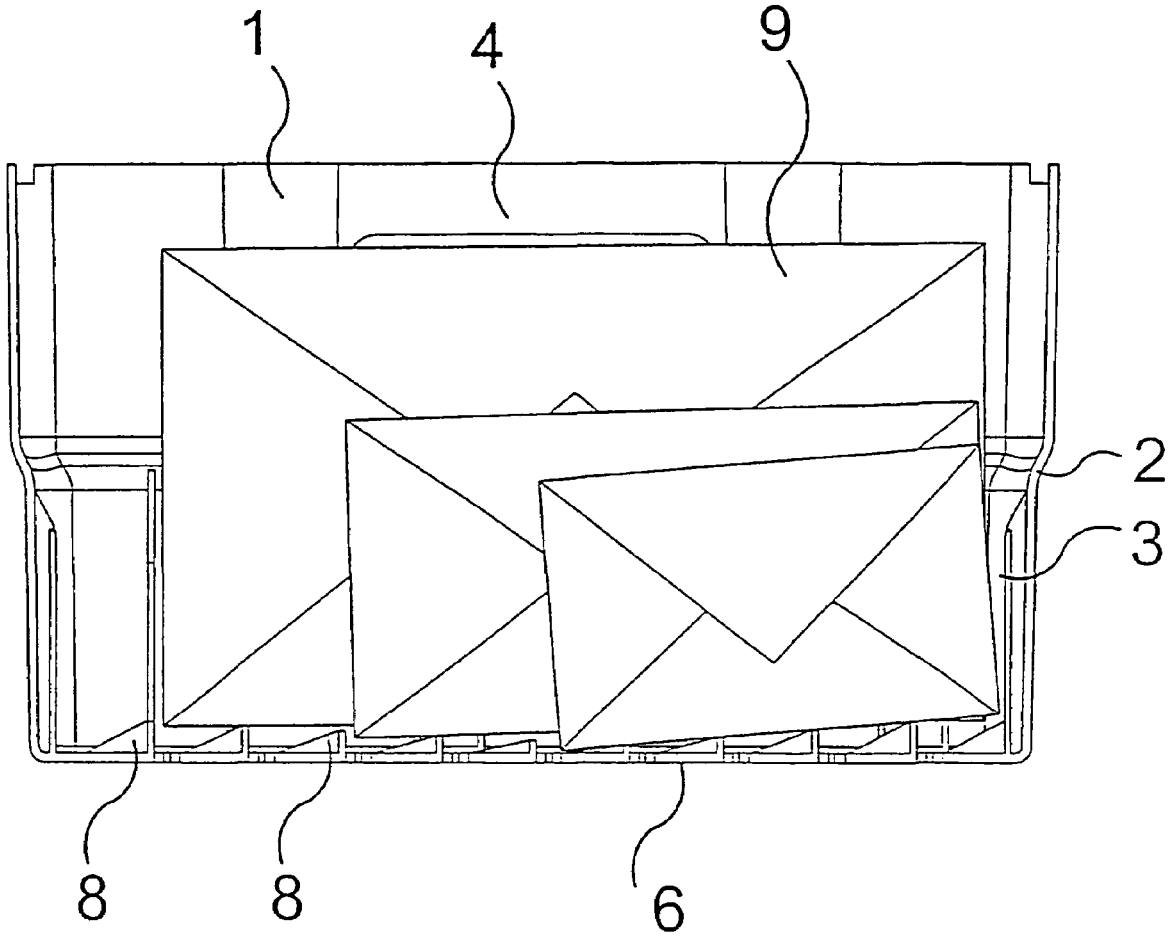
FIG. 2 shows a view of a section through the container parallel to the end wall.
Figure 3:
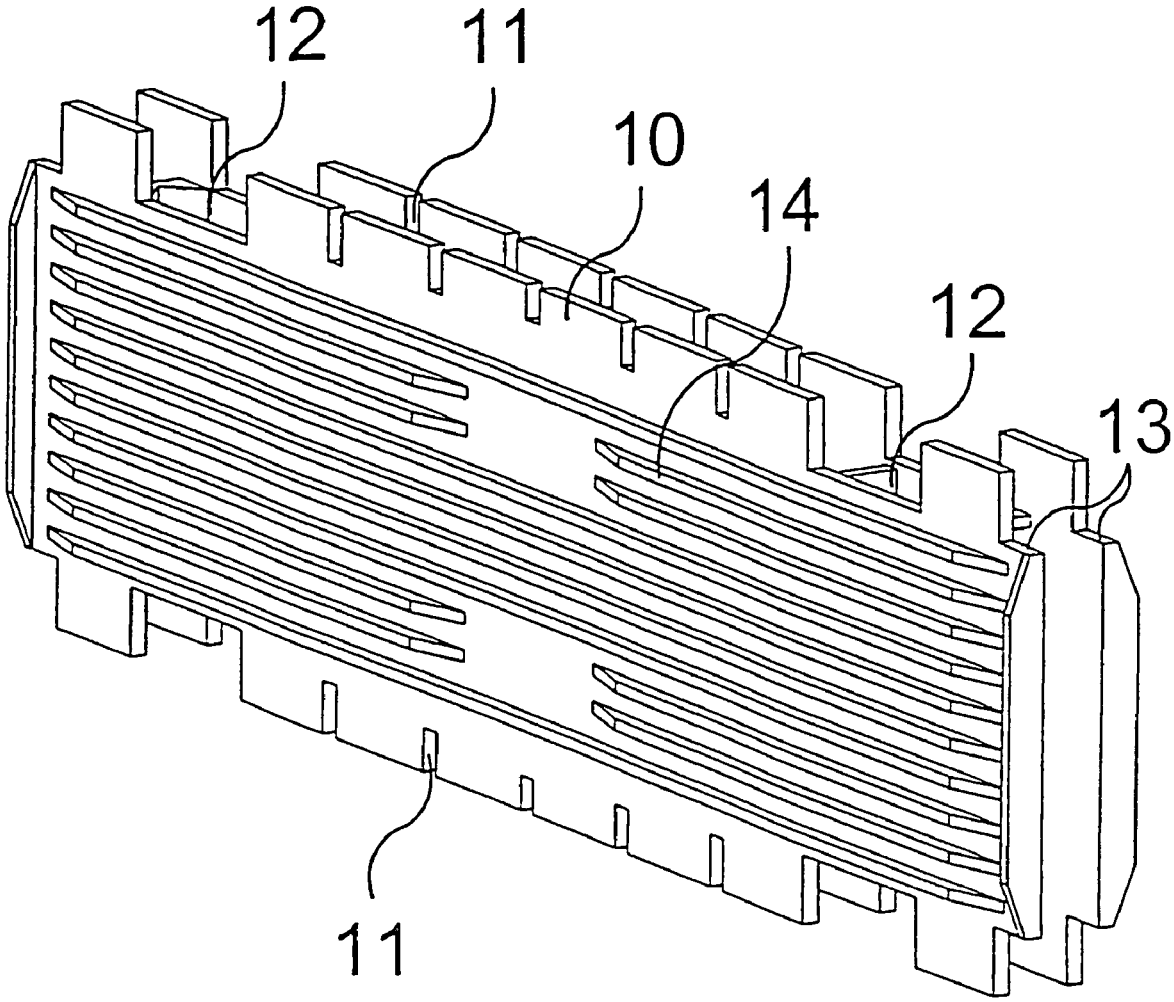
FIG. 3 shows a perspective illustration of the stack support.

This process can be seen particularly well in FIG. 2. Between the longitudinal ribs 7, at the spacing of the recesses 3, there are partial transverse ribs 8, which have a sawtooth-like profile whose tooth peaks are formed by the upper edge of the longitudinal ribs 7. The steep tooth flanks are aimed at the longitudinal wall 2 toward which the mailings 9 are to be oriented, that is to say toward the right-hand longitudinal wall 2. The formation of the stack support 10 can be gathered from FIG. 3. As can be seen, it is of double-walled design, in order to increase the flexural rigidity. In order to increase the rigidity further, there are ribs 14 on the longitudinal surfaces. The stack support 10 is designed identically at the top and bottom so that, given an automatic sequence of the loading and unloading of the container, no attention has to be paid to the orientation of the stack support 10. In order that the stack support 10 can be pushed as far as the base 6 of the container, the upper and lower sides have cutouts 11 for the longitudinal ribs 7. Furthermore, there are on both sides handle receptacles 12 which can be centered for machine handling. At the lateral ends, the stack supports 10 have on each side two shaped elements 13 in the extension of the two walls and at the spacing of the recesses 3 of the container wall from one another, which are angled away from one another at their ends. The two shaped elements 13 on each side are therefore guided in adjacent recesses 3.

Figure 4:
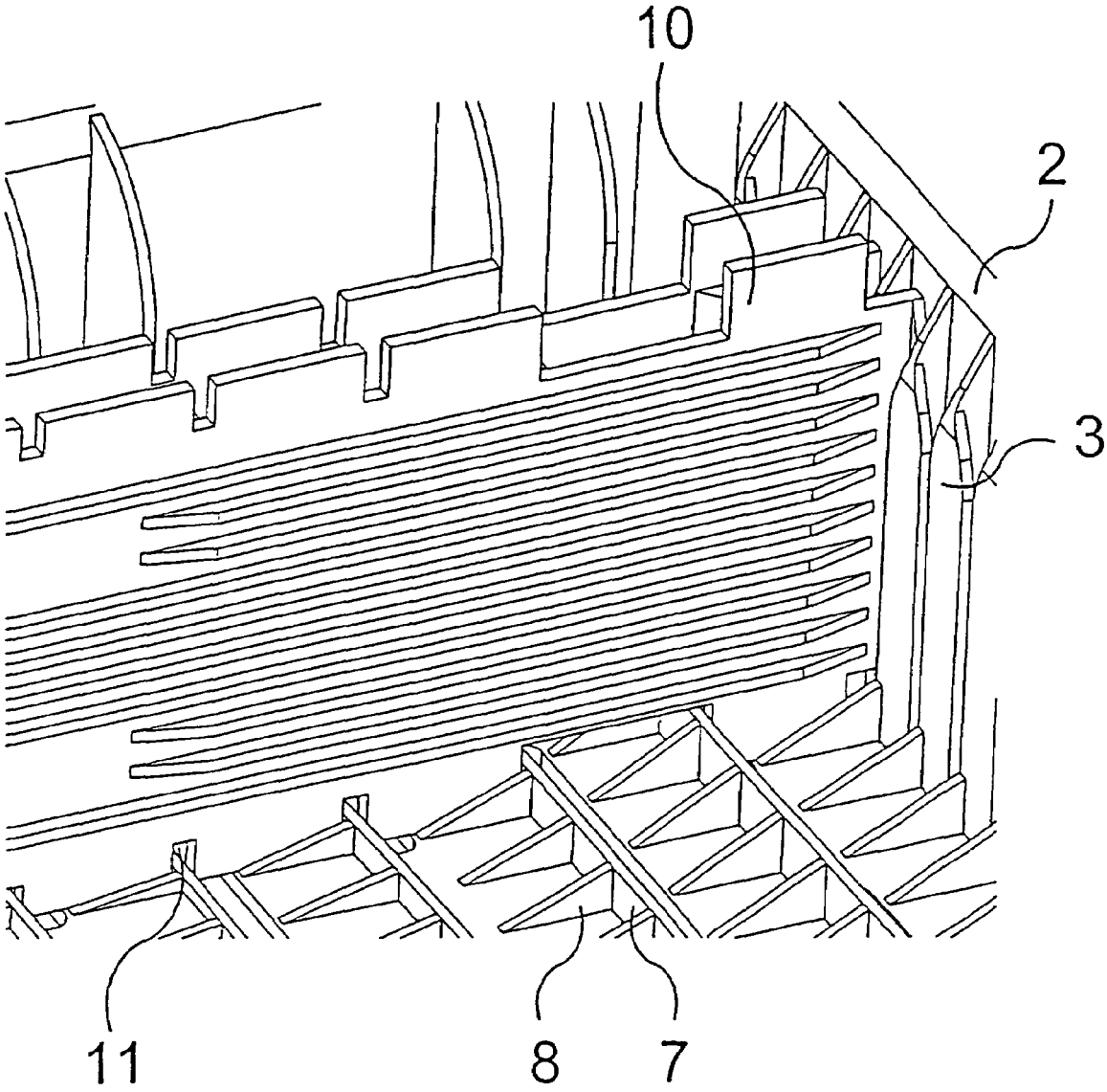
FIG. 4 shows a perspective illustration of a detail of the container with a view of and into the recesses of a lateral longitudinal wall.

This is illustrated particularly well in FIG. 4. Each recess 3 open at the top has a rectangular cross section, there being a gap oriented at right angles to the base in the termination oriented toward the interior of the container. It is also readily possible to see the longitudinal ribs 7 running parallel to the lateral longitudinal walls 2 and the partial transverse ribs 8, which are arranged flush with the edge of the gap oriented toward the viewer.

Since the shaped elements 13 represent an extension of the walls of the stack support 10 with an angled-over portion, it is ensured that the lower part of the stack support 10 is also guided without relatively great play counter to the stacking pressure. It is also possible to see from above the prism-shaped handle receptacle 12, which ensures a defined position of the handle in the stack support 10.

The invention claimed is:

1. A box-like container containing flat mailings in an upright position, comprising:

a stack support that can be removed from an open top of the container, a base, two narrow end walls, and two lateral longitudinal walls, wherein the mailings have large sides, and wherein the large sides are oriented toward the end walls, wherein inner sides of the lateral longitudinal walls comprise elongated recesses which are open at the top and run in substantially straight lines at substantially regular intervals at substantially right angles to the base, in a longitudinal direction of the lateral longitudinal walls, the recesses being in proximity of the lateral longitudinal walls, wherein the lateral longitudinal walls are wider than slot-like openings of the recesses facing the interior of the container and away from the lateral longitudinal walls, wherein at its two lateral ends, the stack support comprises shaped elements which may be pushed in the elongated recesses through the slot-like openings with a form-fitting connection only at substantially right angles to the base, wherein the base includes longitudinal ribs running substantially parallel to the lateral longitudinal walls, wherein heights of the longitudinal ribs decrease from the lateral longitudinal walls toward a center of the container, wherein the base includes, at the spacing of the recesses, transverse ribs subdivided into partial transverse ribs by the longitudinal ribs, and wherein the stack support pushed completely into the container and provided with cutouts for the longitudinal ribs is supported by the partial transverse ribs and lateral guidance against stacking pressure.

2. The box-like container according to claim 1, wherein the stack support comprises a double-walled design and, on each side, comprises two shaped elements at a spacing from one another of the recesses of the container longitudinal walls, which are angled away from one another at their ends.

3. The box-like container according to claim 2, wherein the partial transverse ribs comprise a sawtooth-like profile, whose tooth tips are formed by the upper edges of the longitudinal ribs and the steep flanks of the sawtooth-like partial transverse ribs are oriented toward the longitudinal wall of the container toward which the edges of the mailings are to be oriented.

4. The box-like container according to claim 1, wherein the containers are formed in such a way that a plurality of containers can be stacked on one another, given a substantially same alignment, and, given a mutual alignment rotated through 180° about the vertical axis, the containers being stackable partly in one another, and the stack support being designed to be only so high that it does not touch the base of the respective upper container when they are stacked in one another.

5. The box-like container according to claim 1, wherein the stack support comprises two handle receptacles which can be centered for machine handling.

* * * * *